US007010925B2

(12) United States Patent
Sienel et al.

(10) Patent No.: US 7,010,925 B2
(45) Date of Patent: Mar. 14, 2006

(54) METHOD OF CONTROLLING A CARBON DIOXIDE HEAT PUMP WATER HEATING SYSTEM

(75) Inventors: Tobias Sienel, Easthampton, MA (US); Yu Chen, East Hartford, CT (US); Bryan Eisenhower, East Hartford, CT (US); Julio Concha, Rocky Hill, CT (US); Young Kyu Park, Simsbury, CT (US); Lili Zhang, East Hartford, CT (US); Jeffrey Nieter, Coventry, CT (US); Nicolas Pondicq-Cassou, Lyons (FR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/862,589

(22) Filed: Jun. 7, 2004

(65) Prior Publication Data

US 2005/0268625 A1 Dec. 8, 2005

(51) Int. Cl.
*F25B 1/00* (2006.01)

(52) U.S. Cl. ..... 62/115; 62/126

(58) Field of Classification Search ..... 62/125, 62/126, 129, 132, 208, 210, 186, 205, 180, 62/238, 115; 236/20 R See application file for complete search history.

(56) References Cited

U.S. PATENT DOCUMENTS

| | | | | | |
|---|---|---|---|---|---|
| 4,238,931 | A | * | 12/1980 | Campbell | 62/183 |
| 4,262,736 | A | * | 4/1981 | Gilkeson et al. | 165/11.1 |
| 4,301,660 | A | * | 11/1981 | Mueller et al. | 62/126 |
| 4,381,549 | A | * | 4/1983 | Stamp et al. | 62/126 |
| 4,474,227 | A | * | 10/1984 | Reedy | 237/2 A |
| 4,574,871 | A | * | 3/1986 | Parkinson et al. | 165/11.1 |
| 5,438,844 | A | * | 8/1995 | Hoglund et al. | 62/155 |
| 5,440,890 | A | * | 8/1995 | Bahel et al. | 62/81 |
| 5,465,588 | A | * | 11/1995 | McCahill et al. | 62/127 |
| 5,630,325 | A | * | 5/1997 | Bahel et al. | 62/222 |
| 6,119,950 | A | * | 9/2000 | Albanello et al. | 236/46 R |
| 6,212,894 | B1 | * | 4/2001 | Brown et al. | 62/180 |
| 6,658,373 | B1 | * | 12/2003 | Rossi et al. | 702/185 |
| 2003/0055603 | A1 | * | 3/2003 | Rossi et al. | 702/185 |

FOREIGN PATENT DOCUMENTS

| | | | |
|---|---|---|---|
| JP | 11-193971 | A * | 7/1999 |
| JP | 2000-146347 | A * | 5/2000 |

* cited by examiner

*Primary Examiner*—Mohammad M. Ali
(74) *Attorney, Agent, or Firm*—Carlson, Gaskey & Olds

(57) ABSTRACT

A method of detecting and diagnosing operating conditions for a heat pump water heating system includes the steps of monitoring system operating conditions and comparing actual operating conditions to predicted operating conditions. The predicted operating conditions are based on expected pressures and temperatures given current system inputs. A difference between the actual and expected values for refrigerant pressures and temperature outside a desired range provides indication of a fault in the system. The system controller initiates a prompt to alert of the need for maintenance and direct to potential causes.

15 Claims, 1 Drawing Sheet

METHOD OF CONTROLLING A CARBON DIOXIDE HEAT PUMP WATER HEATING SYSTEM

BACKGROUND OF THE INVENTION

This invention is generally directed towards a method of operating a heat pump water heating system and specifically to a method of detecting and diagnosing operating conditions of a heat pump water heating system.

Chlorine containing refrigerants have been phased out due to environmental considerations. Many alternatives have been proposed for replacing chlorine containing refrigerants including carbon dioxide. Carbon dioxide has a low critical point, which causes most air conditioning systems utilizing carbon dioxide to run partially above a critical point or to run trans-critical under most conditions. The pressure of any sub critical fluid is a function of temperature under saturated conditions (both liquid and vapor present). However, when temperature of the fluid is higher than the critical temperature, the pressure becomes a function of fluid density.

Trans-critical refrigeration systems utilize a refrigerant compressed to high pressure and high temperature in a compressor. As the refrigerant enters a gas cooler, heat is removed from the refrigerant and transferred to a fluid medium such as water. In a heat pump water heater, water heated in the gas cooler is used to heat water within a hot water tank. Refrigerant flows from the gas cooler to an expansion valve. The expansion valve regulates the flow of refrigerant between high-pressure and low-pressure. Control of refrigerant through the expansion valve controls the flow and efficiency of the refrigerant circuit. Refrigerant flows from the expansion valve to an evaporator.

In the evaporator, low-pressure refrigerant accepts heat from the air to become superheated. Superheated refrigerant from the evaporator flows into the compressor to repeat the cycle.

The system is controlled to vary refrigerant and water flow depending on current operating conditions. Degradation of system devices can detrimentally affect system performance and operating costs. Further, in some instances changes in system performance are not readily apparent and can therefore go undetected. Operating costs are greatly reduced by operating the system at optimal conditions. Further, reducing system down time greatly reduces operating costs.

Accordingly, it is desirable to develop a method of detecting system faults and diagnosing system problems to reduce system down time and increase operating efficiency.

SUMMARY OF THE INVENTION

The present invention is a method of detecting and diagnosing operating conditions of a heat pump water heating system by monitoring operation variables and their response to system inputs.

A heat pump water heating system includes a transcritical vapor compression circuit. The vapor compression circuit includes a compressor, a gas cooler, and an evaporator. The gas cooler transfers heat to a water circuit that in turn heats water within a hot water tank. Water temperature is regulated by varying the flow of water through the gas cooler. Slower water flow provides for greater absorption of heat, resulting in greater water temperatures. Increasing the flow of water decreases heat absorption causing a decrease in water temperature.

A controller controls the heat pump water heating system to provide and maintain a desired temperature of water within the water tank. Sensors throughout the system are constantly monitored and parameters adjusted for optimized operation. The system detects and diagnosis problems with the system by monitoring and comparing actual measured conditions with predicted conditions based on system inputs. Detection and diagnosing problems increases system efficiency by reducing system maintenance and down time.

Accordingly, the method of detecting and diagnosing system operating conditions of this invention reduces system down time and increases operating efficiency.

BRIEF DESCRIPTION OF THE DRAWINGS

The various features and advantages of this invention will become apparent to those skilled in the art from the following detailed description of the currently preferred embodiment. The drawing that accompanies the detailed description can be briefly described as follows.

DETAILED DESCRIPTION OF THE PREFERRED EMBODIMENT

Figure 1:
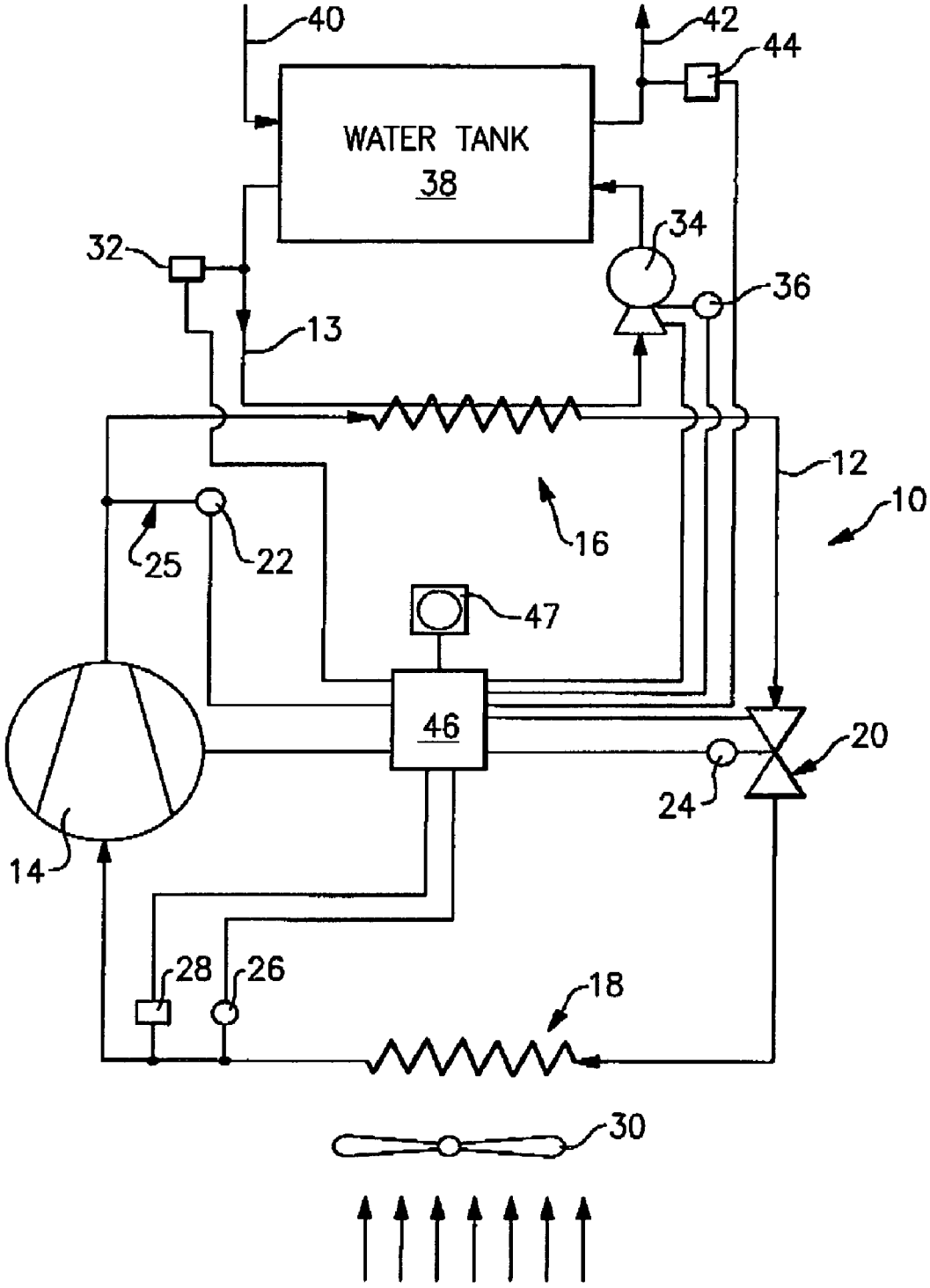
FIG. 1 is a schematic illustration of a CO heat pump water heater.

Referring to FIG. 1, a heat pump system 10 is schematically shown and includes a refrigerant compressor 14, which drives refrigerant through a vapor compression circuit 12. Preferably, the refrigerant used in this system is carbon dioxide. Because carbon dioxide has a low critical point, vapor compression circuits utilizing carbon dioxide refrigerant usually run trans critical. Although carbon dioxide is preferably used, it is within the scope of this invention to use other refrigerants as are known to worker skilled in the art. The vapor compression circuit 12 includes the compressor 14, a heat exchanger 16, an expansion valve 20, and an evaporator 18. The evaporator 18 includes a fan 30 that is selectively actuated to blow air across the evaporator 18.

A water circuit 13 is in thermal contact with the vapor compression circuit 12 at the heat exchanger 16. A pump 34 drives water flowing through the water circuit 13. Water flowing through the water circuit 13 absorbs heat rejected from the refrigerant in the heat exchanger 16. Water within the water circuit 13 in turn transfers heat to water within a water tank 38. The water tank includes an inlet 40 and an outlet 42. A temperature sensor 44 measures outlet water temperature and communicates that information with the controller 46.

The vapor compression circuit 12 operates by alternately compressing and expanding refrigerant to absorb and transfer heat to water within the water circuit 13. Refrigerant exiting the compressor 14 is at a high temperate and high pressure. This high temperature, high-pressure refrigerant is flowed through the heat exchanger 16. In the heat exchanger 16, the refrigerant rejects heat into the water circuit 13. Refrigerant emerging from the heat exchanger 16 proceeds to an expansion valve 20. The expansion valve 20 controls the flow of refrigerant from high pressure to low pressure. Preferably, the expansion valve 20 is variable to allow adaptation of refrigerant flow to changing operating conditions. The expansion valve 20 can be of any configuration known to a worker skilled in the art.

System efficiency is affected by many different parameters and environmental conditions. For example, loss of refrigerant due to leakage or evaporation reduces the amount of heat that can be absorbed and rejected. The method of this invention detects and diagnosis system operating conditions of a heat pump water heating system by monitoring system parameters and comparing the actual measured parameter with predicted parameters based on current system conditions and inputs.

The method monitors the amount of refrigerant within the system 10 to detect a reduction in refrigerant below a desired amount. The amount or charge of refrigerant is monitored by measuring refrigerant pressure and temperature between the evaporator 18 and the compressor 14. A temperature sensor 28 and a pressure sensor 26 are disposed within the vapor compression circuit 12 between the compressor 14 and evaporator 18. Although the pressure and temperature sensors 26, 28 are disposed between the evaporator 18 and the compressor, a worker skilled in the art with the benefit of this invention would understand that refrigerant temperature and pressure can be monitored at other locations within the vapor compression circuit 12.

If the refrigerant is in saturated condition the pressure and temperature of refrigerant are directly related. Therefore, measuring and monitoring the pressure of refrigerant in the saturated state provides knowledge of the refrigerant temperature. However, when the refrigerant is not in the saturated state this relationship no longer holds and a direct measurement of the temperature is required.

In some instances, the saturated temperature corresponding to a pressure of the refrigerant is much different than the actual temperature of the refrigerant. Such an occurrence is known in the art as a super heated condition. A super heated condition occurs when the actual temperature is greater than the saturated temperature that would correspond to the given refrigerant pressure. A super heated condition is evidence of a loss of refrigerant within the system.

The system compares the actual temperature provide by temperature sensor 28 with a predicted temperature relating to the pressure of refrigerant provided by the pressure sensor 26. The predicted temperature is calculated as a function of the ambient conditions (typically air and water temperature), for example by using a look-up table, determined experimentally. The ambient conditions must be sensed by appropriate sensors. A difference between the actual temperature and the predicted temperature outside a predetermined range indicates a loss of refrigerant. In response to a detected low refrigerant condition, the controller 46 initiates a prompt 47 to alert of the problem. Further, the controller 46 can also shut the system 10 down to prompt maintenance.

The temperature sensor 28 and pressure sensor 26 between the compressor 14 and evaporator 18 is also used to determine if there is a malfunction with the fan 30. If the fan 30 is operating properly, heat will be absorbed from the atmosphere within the evaporator 18 in a predictable way. The refrigerant temperature should react in a predictably way upon actuation of the fan 30 and the corresponding airflow over the evaporator 18.

A problem with the fan 30 is indicated if a difference between a predicted refrigerant temperature and the actual temperature measured monitored by the temperature sensor 28 is greater than a desired amount. If the temperature and pressure of the refrigerant correspond, but do not reflect the predicted levels given operation of the fan 30; a problem with the fan 30 is indicated. Upon an indication of a fault with the fan 30, the controller 46 will provide a prompt to alert and direct maintenance to the source of the problem.

Another example of conditions monitored by the system 10 includes monitoring of the expansion valve 20. The expansion valve 20 operates to vary the flow of refrigerant through the vapor compression circuit 12. If the expansion valve 20 is not operating properly the flow of refrigerant will not react as desired. Faulty operation of the expansion valve 20 can cause a difference between the high and low pressures within the vapor compression circuit 12 outside of a desired range. Again, the desired range is determined experimentally, and is a function of the environmental conditions. A pressure sensor 22 disposed between the compressor 14 and the heat exchanger 16 monitors a first refrigerant pressure 25. The first refrigerant pressure 25 between the compressor 14 and the heat exchanger 16 should correspond with a setting of the expansion valve 20.

A difference between an expected pressure between the compressor 14 and the heat exchanger 16 given input to the expansion valve 20 outside of a desired range is an indication of possible expansion valve 20 problems. A pressure sensor 24 measures refrigerant pressure within the expansion valve 20. Actuation of the expansion valve 20 results in an expected pressure of refrigerant between the compressor 14 and heat exchanger 16. A fault is indicated in response to a difference between expected and actual refrigerant pressure outside a desired range. In response to an indication of an expansion valve fault the controller 46 initiate a prompt to alert and direct attention to the fault.

Another condition monitored by the system is water pump speed. The water pump 34 regulates the flow of water through the water circuit 13 to maintain the water temperature within the water tank 38. Failures with the water pump 34 or degradation of the heat exchanger 16 reduce efficiency of the system 10. A temperature sensor 32 monitors water temperature within the water circuit 13. The speed of the water pump 34 corresponds with a predicted temperature gain of water. The predicted temperature of the water given water pump speed is compared to the actual temperature value as is measured by the temperature sensor 32. A speed sensor 36 monitors the pump speed. The sensor 36 provides information on pump speed that is used to predict and expected water temperature range. The sensor 36 may be of any type known to a worker skilled in the art. If the difference between the actual and predicted values of water temperature is greater than a pre-determined range, a fault is detected and the system is either shut down or a fault condition is indicated. As discussed above, the pre-determined range depends on the environmental conditions.

There are several possible causes for differences in actual and predicted water temperatures. One possible cause is that the pump 34 may not be rotating at sufficient speed given input to the pump 34. The pump 34 is preferably driven by an electric motor as is known. A current supply to the electric motor governs the speed of the pump 34. The current supplied to the electric motor can be measured to indicate an expected pump speed that can be compared to the actual pump speed as measured by the speed sensor 36. Further, the current being drawn by the electric motor correlates to a given pump speed. The pump speed as measured by the speed sensor 36 correlates to the predicted water temperature. Differences between the predicted and the actual water temperature cause the controller 46 to indicate a fault within the system 10.

Another cause for differences in predicted and actual water temperature is calcium build up on the heat exchanger 16. Condensation within the heat exchanger 16 can cause calcium build up that degrades heat transfer between the vapor compression circuit 12 and the water circuit 13. Calcium degrades heat transfer such the actual water temperature does not change as expected in response to changes in pump speed. Again, in such instances the controller 46 will initiate an alert to prompt maintenance of the system 10.

The heat pump hot water heating system of this invention detects and diagnosis operating conditions to improve reliability; detect system degradation, reduce system maintenance, and improve overall system efficiency.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A method of detecting heat pump operating conditions comprising the steps of:

a) compressing a refrigerant with a compressor device;

b) cooling the refrigerant by exchanging heat with a fluid medium;

c) expanding said refrigerant to a low pressure in an expansion device;

d) evaporating said refrigerant within a heat exchanger;

e) monitoring a refrigerant pressure that varies in response to actuation of said expansion device;

f) comparing said monitored refrigerant pressure with a predicted refrigerant pressure expected responsive to actuation of said expansion device; and g) determining a fault condition in response to a magnitude of difference between the monitored refrigerant pressure and the predicted refrigerant pressure.

2. The method of claim 1, wherein said refrigerant is carbon dioxide.

3. The method of claim 1, wherein said heat pump exchanges heat with a water heater.

4. The method of claim 1, wherein said monitored refrigerant pressure is monitored between said compressor and said heat exchanger.

5. The method of claim 1, wherein a second pressure is monitored between the evaporator and the compressor, and a temperature of said refrigerant is monitored between said compressor and said evaporator.

6. The method of claim 5, wherein a loss of refrigerant is determined responsive to a predicted temperature based on said second pressure being outside an actual monitored temperature.

7. The method of claim 5, wherein said evaporator includes a fan for blowing air across said evaporator, and a fault with said fan determined in response to an actual temperature being different than an expected temperature.

8. The method of claim 1, including a second temperature sensor disposed within the water circuit for measuring water temperature entering said heat exchanger.

9. The method of claim 8, wherein a fault is detected with said water pump in response to said temperature being less than a predicted temperature.

10. The method of claim 8, including a sensor monitoring pump speed, and a calcification of said heat exchanger determined in response to predetermined difference between predicted water temperature based on pump flow and actual water temperature.

11. The method of claim 1, wherein a loss of refrigerant is determined responsive to a superheat condition detected, wherein said superheat condition is a difference between a predicted temperature corresponding to a pressure, and an actual temperature.

12. A method of detecting heat pump operating conditions comprising the steps of:

a) compressing a refrigerant with a compressor device;

b) cooling the refrigerant by exchanging heat with a fluid medium;

c) expanding said refrigerant to a low pressure in an expansion device;

d) evaporating said refrigerant within a heat exchanger;

e) monitoring an operating condition, including monitoring a first pressure between said compressor device and said heat exchanger;

f) comparing said monitored operating condition with a predicted operating condition; and g) determining a fault condition in response to a magnitude of difference between the monitored operating condition and the predicted operating condition, including determining a fault condition in response to actuation of said expansion device not followed by a corresponding change in the first pressure.

13. A method of detecting a fault in heat pump operating conditions comprising the steps of:

a) pumping water through a heat exchanger with a fluid pump;

b) monitoring a water temperature entering the heat exchanger;

c) monitoring a parameter of the fluid pump;

d) predicting an expected water temperature based on the monitored parameter of the fluid pump;

e) comparing the monitored water temperature with the expected water temperature; and f) determining a fault condition responsive to a difference between the monitored water temperature and the expected water temperature.

14. The method as recited in claim 13, wherein said step f) includes determining a fault with said heat exchanger responsive to a predetermined difference between said expected water temperature for a given pump speed and said monitored water temperature.

15. The method as recited in claim 13, wherein said step f) includes determined a fault with the fluid pump responsive to said monitored temperature being less then said expected water temperature.

* * * * *